US006547533B2

(12) United States Patent
Ota et al.

(10) Patent No.: US 6,547,533 B2
(45) Date of Patent: Apr. 15, 2003

(54) AXIAL MOVEMENT RESTRICTION MEANS FOR SWASH PLATE COMPRESSOR AND COMPRESSOR ASSEMBLY METHOD

(75) Inventors: Masaki Ota, Kariya (JP); Kazuya Kimura, Kariya (JP); Hiroaki Kayukawa, Kariya (JP); Satoshi Umemura, Kariya (JP); Ken Suitou, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/758,599

(22) Filed: Jan. 10, 2001

(65) Prior Publication Data

US 2001/0021348 A1 Sep. 13, 2001

(30) Foreign Application Priority Data

Jan. 11, 2000 (JP) ..... 2000-002971

(51) Int. Cl.[7] ..... F04B 1/26; F04B 1/12; F01B 3/00

(52) U.S. Cl. ..... 417/222.2; 417/269; 92/71

(58) Field of Search ..... 417/222.2, 269; 92/71

(56) References Cited

U.S. PATENT DOCUMENTS 4,321,019 A * 3/1982 Degawa et al. ..... 417/269
4,715,739 A * 12/1987 Ruegg et al. ..... 285/381.2
4,948,343 A * 8/1990 Shimizu ..... 417/222.2
5,063,829 A * 11/1991 Takao et al. ..... 417/222.2
5,137,431 A * 8/1992 Kiyoshi et al. ..... 417/269
5,299,918 A * 4/1994 Teruo ..... 417/222.1
5,316,446 A * 5/1994 Kimura et al. ..... 417/222.1
5,699,716 A 12/1997 Ota et al. ..... 92/12.2
5,897,298 A 4/1999 Umemura ..... 417/222.2
5,975,860 A * 11/1999 Obayashi et al. ..... 417/223

FOREIGN PATENT DOCUMENTS

JP 58-183881 * 10/1983 ..... F04B/9/12
JP 2-23827 3/1990
JP 8-284816 10/1996

* cited by examiner

*Primary Examiner*—Charles G. Freay
*Assistant Examiner*—Timothy P. Solak
(74) *Attorney, Agent, or Firm*—Morgan & Finnegan, LLP

(57) ABSTRACT

A piston type compressor has a housing, a crank chamber and a drive shaft supported by the housing. A front restriction and a rear restriction are located in the housing. The front and rear restrictions restrict axial movement of the drive shaft. The front restriction restricts forward movement of the drive shaft. The rear restriction restricts rearward axial movement of the drive shaft. A first clearance is located between the rear end of the drive shaft and the rear restriction when the drive shaft is restricted by the front restriction. A second clearance is formed between the piston and a valve plate when the drive shaft is restricted by the front restriction and when the piston is in the top dead center position. The first clearance is narrower than the second clearance. The method of assembly the piston easily sets the first clearance.

10 Claims, 7 Drawing Sheets

AXIAL MOVEMENT RESTRICTION MEANS FOR SWASH PLATE COMPRESSOR AND COMPRESSOR ASSEMBLY METHOD

BACKGROUND OF THE INVENTION

The present invention relates to a piston type compressor used in, for example, a vehicle air conditioner and a compressor assembly method.

A conventional variable displacement swash plate type compressor shown in FIG. 7 includes an electromagnetic clutch 101 between a drive shaft 104 and a vehicle engine Eg, which is an external driving source. The electromagnetic clutch 101 includes a rotor 101*b* connected to the engine Eg and an armature 101*a* integrally, rotatably secured to the drive shaft 104. When the electromagnetic clutch 101 is turned on, the armature 101*a* is pulled toward the rotor 101*b* and engages the rotor 101*b*, which engages the clutch 101. Accordingly, the power of the engine Eg is transmitted to the drive shaft 104. When the electromagnetic clutch 101 is turned off, the armature 101*a* is moved away from the rotor 101*b*, which disengages the clutch 101. Accordingly, the drive shaft 104 is disconnected from the engine Eg.

A rotor 105 is fixed to the drive shaft 104 in a crank chamber 107. A thrust bearing 111 is located between the rotor 105 and a housing 110. A swash plate 103 is connected, through a hinge mechanism 106, to the rotor 105. The swash plate 103 is supported on the drive shaft 104 and inclines with respect to the axis L. The swash plate 103 is driven integrally with the drive shaft 104 through the hinge mechanism 106. A restriction ring 109 is provided on the drive shaft 104. When the swash plate 103 contacts the restriction ring 109, the swash plate 103 is defined at the minimum inclination angle position.

A cylinder bore 108 is formed in the housing 110. A piston 102 is accommodated in the cylinder bore 108 and is connected to the swash plate 103.

The inclination angle of the swash plate 103 is changed by changing the difference between the pressure in the crank chamber 107 and the pressure in the cylinder bore 108 through the piston 102. Thus, when the inclination angle is changed, the stroke of the piston 102 is changed so that the discharge displacement is changed.

When the inner pressure of the crank chamber 107 is increased and the difference between the increased pressure in the crank chamber 107 and the pressure in the cylinder bore 108 becomes large, the inclination angle of the swash plate 103 decreases and the discharge displacement of the compressor becomes small. A broken line in FIG. 7 shows the swash plate 103 at the minimum inclination angle position, where it contacts the restriction ring 109. On the other hand, when the inner pressure of the crank chamber 107 is decreased and the difference between the decreased pressure in the crank chamber 107 and the pressure in the cylinder bore 108 becomes small, the inclination angle of the swash plate 103 increases and the discharge displacement of the compressor becomes large. As a result, the swash plate 103 is moved to the maximum inclination angle position.

When refrigerant gas is being compressed, and in particular, when the swash plate 103 is at the maximum inclination angle position, a strong compression load force is transmitted through the piston 102, the swash plate 103, the hinge mechanism 106, the rotor 105 and the drive shaft 104 to the inner wall surface of the housing 110.

When the electromagnetic clutch 101 is turned off, or when the engine Eg is stopped, the pressure in the crank chamber 107 is increased and the swash plate 103 is moved to the minimum inclination angle position. As a result, the compressor is stopped in a state where the inclination angle of the swash plate 103 is minimum, in other words, in a state where the discharge displacement is minimum. Therefore, the compressor is always started from the minimum discharge displacement, where the load torque is minimum. This reduces the shock generated when the compressor is started. In addition, when a vehicle is abruptly accelerated, the load on the engine Eg is reduced. Thus, the pressure in the crank chamber abruptly increases so that the discharge displacement of the compressor becomes minimum.

However, when the pressure in the crank chamber 107 is abruptly increased, the inclination angle of the swash plate 103 is rapidly reduced. Accordingly, the swash plate 103 (as shown by the broken line in FIG. 7) moves to the minimum inclination angle position and strongly presses against the restriction ring 109. Further, the swash plate 103 pulls the rotor 105 rearward (in the right direction of FIG. 7) through the hinge mechanism 106. As a result, the drive shaft 104 is moved axially rearward against the force of a support spring 113.

When the drive shaft 104 is moved in the rear direction when the compressor is stopped by disengagement of the electromagnetic clutch 101, the armature 101*a*, which is secured to the drive shaft 104, is moved toward the rotor 101*b*. This may eliminate the clearance between the armature 101*a* and the rotor 101*b*, and the armature 101*a* may contact the rotor 101*b*, which is rotating. As a result, noise or vibration occurs, or, in spite of the deactivation of the clutch 101, the power of the engine Eg may be transmitted to the drive shaft 104.

When the drive shaft 104 is moved rearward, the piston 102, which is connected to the drive shaft 104 through the rotor 105, the hinge mechanism 106, and the swash plate 103 are also moved rearward. Thus, the top dead center position of the piston 102 is moved toward a valve plate 112. Accordingly, the piston, which reciprocates in the cylinder bore 108, may repeatedly collide with the valve plate 112. As a result, vibration or noise occurs.

To prevent the movement of the drive shaft 104 in the rearward direction, increasing the force applied by the supporting spring 113 has been considered. However, when the force of the supporting spring 113 is increased, the life of the thrust bearing 111 between the housing 110 and the rotor 105 is reduced, and the power loss of the engine Eg is increased.

SUMMARY OF THE INVENTION

The object of the present invention is to provide a piston type compressor that requires no spring for urging a drive shaft, and an assembly method for the same.

To attain the above-mentioned object, the present invention provides a piston type compressor. The compressor includes a housing and a crank chamber formed in the housing. A drive shaft is rotatably supported by the housing in the crank chamber. The drive shaft has an end surface. A cylinder bore is formed in the housing. A piston is located in the cylinder bore. The piston reciprocates between a top dead position and a bottom dead position. A valve plate is located at an opposite side of the piston from the crank chamber. A swash plate is connected with the piston to change the rotation of the drive shaft to reciprocation of the piston. The swash plate integrally rotates with the drive shaft. A front restriction and a rear restriction are located in the housing and for restricting a movement in the axial direction of the drive shaft. The front restriction restricts the axial movement of the drive shaft in a forward direction. The rear restriction restricts axial movement of the drive shaft in a rear direction. A first clearance is formed between the end surface of the drive shaft and the rear restriction when the movement of the drive shaft is restricted by the front restriction. A second clearance is formed between the piston and the valve plate when the movement of the drive shaft is restricted by the front restriction and when the piston is in the top dead center position. The first clearance is smaller than the second clearance.

The present invention also provides an another piston type compressor. The compressor includes a housing and a crank chamber formed in the housing. A drive shaft is rotatably supported by the housing in the crank chamber. The drive shaft has an end surface. A cylinder bore is formed in the housing. A piston is located in the cylinder bore. The piston reciprocates between a top dead position and a bottom dead position. A valve plate is located at an opposite side of the piston from the crank chamber. A swash plate is connected with the piston to change the rotation of the drive shaft to reciprocation of the piston. The swash plate integrally rotates with the drive shaft. An electromagnetic clutch couples and decouples a power source and the drive shaft. The power source is located outside of the housing. A driven rotary member is supported on the housing. An armature is integrally connected with the drive shaft and facing the rotary member. An electromagnetic coil generates an electromagnetic force to engage the armature with the rotary member. A front restriction and a rear restriction are located in the housing for restricting axial movement of the drive shaft. The front restriction restricts movement of the drive shaft in a forward direction. The rear restriction restricts axial movement of the drive shaft in a rearward direction. A first clearance is formed between the end surface of the drive shaft and the rear restriction when the movement of the drive shaft is restricted by the front restriction, wherein a second clearance is formed between the armature and the driven rotary member when the drive shaft is restricted by the front restriction. The first clearance is smaller than the second clearance.

The present invention also provides an assembly method for piston type compressor. The method comprises locating an end portion of a drive shaft in an accommodation hole of a housing and pressing a restriction member by a first portion of a jig into the accommodation hole. The pressing includes pressing the restriction member axially in the accommodation hole until movement of the drive shaft is restricted by a wall of the housing after a second portion of the jig contacts an end surface of the drive shaft, and the pressing step further includes forming a predetermined clearance between the end surface of the drive shaft and a restriction surface of the restriction member.

The present invention provides another an assembly method for a piston type compressor. The method includes locating an end portion of a drive shaft in an accommodation hole of a housing, and pressing a contact member on the drive shaft by a first portion of a jig. The pressing includes pressing the contact member axially on the drive shaft by the first portion of the jig to a position where a second portion of the jig contacts a wall in which the accommodation hole is formed, and the pressing further includes forming a predetermined clearance between the end surface of the contact member and a valve plate.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 2(*a*) is an enlarged cross sectional view of a portion of FIG. 2;

FIG. 3(*b*) is a partial enlarged cross-sectional view illustrating a state after a restriction member is accommodated in an accommodation hole;

FIG. 4(*a*) is an enlarged cross sectional view of a portion of FIG. 4;

FIG. 5(*b*) is a partial enlarged cross-sectional view illustrating a state after the restriction member in FIG. 4 is accommodated in an accommodation hole;

DETAILED DESCRIPTION OF THE PREFERRED EMBODIMENTS

A piston type variable displacement swash plate type compressor used in a vehicle air conditioner and a compressor assembly method will be described with reference to FIGS. 1 to 3 (*b*).

Figure 1:
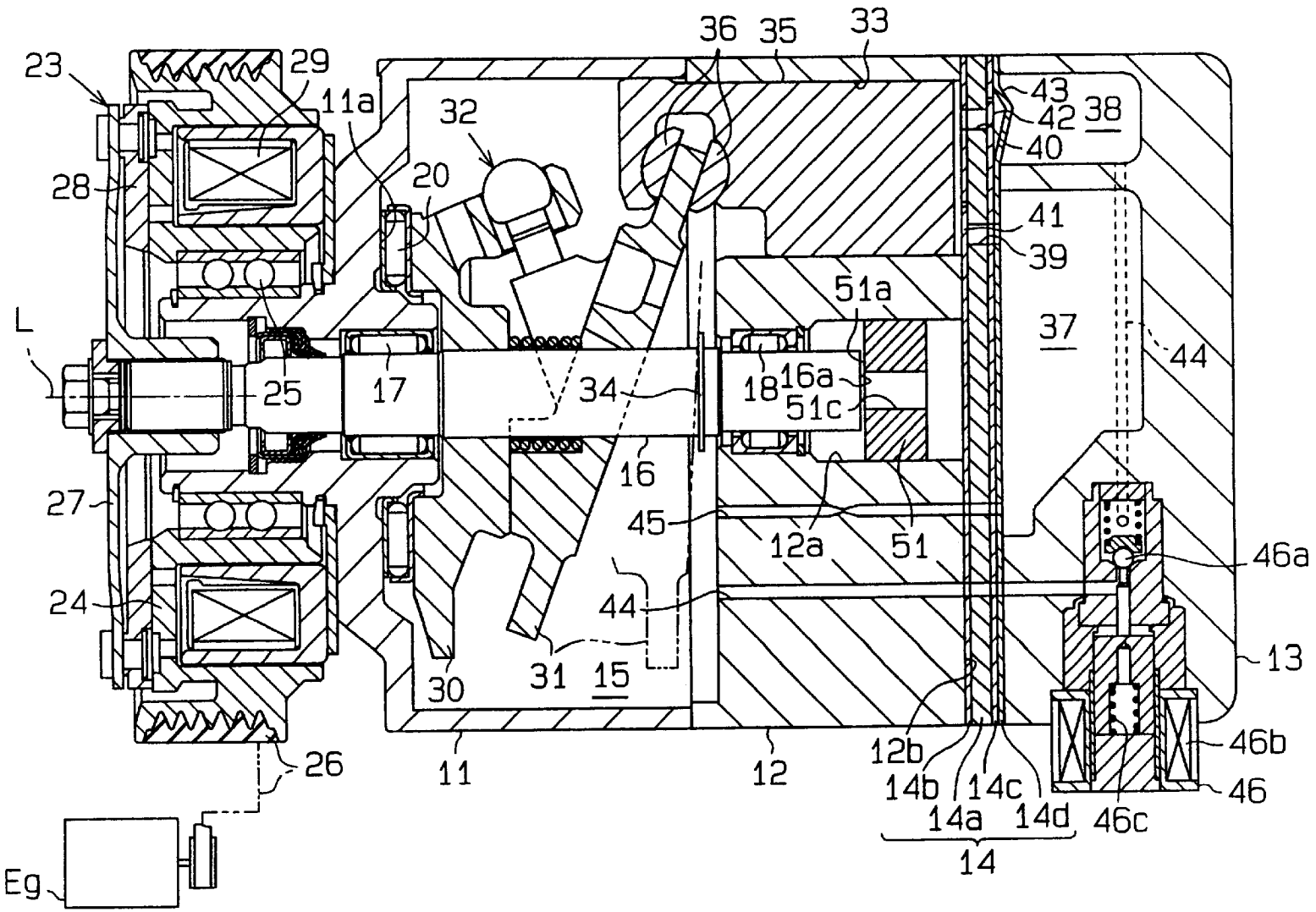
FIG. 1 is a cross-sectional view of a variable displacement swash plate type compressor in a first embodiment of the present invention.

As shown in FIG. 1, a front housing member 11 and a rear housing member 13 are connected to a cylinder block 12. The cylinder block 12 is made of an aluminum type metallic material. A valve plate 14 is provided between the rear housing member 13 and the cylinder block 12. The front housing member 11, the cylinder block 12, and the rear housing member 13 are fastened by a through bolt or the like. The housing of the compressor includes the front housing member 11, the cylinder block 12, and the rear housing member 13. The left side of FIG. 1 shows the front end of the compressor and the right side of FIG. 1 shows the rear end.

The valve plate 14 includes a main plate 14*a*, a first subplate 14*b* and a second subplate 14*c*. The subplates 14*b*, 14*c* sandwich the main plate 14*a*. A retainer plate 14*d* is provided on the second subplate 14*c*. The front surface of the first subplate 14*b* of the valve plate 14 is connected to a rear end surface 12*b* of the cylinder block 12.

A crank chamber 15 is defined between the front housing member 11 and the cylinder block 12. A drive shaft 16 is rotatably supported on the front housing member 11 and the cylinder block 12 so that it passes through the crank chamber 15. The drive shaft is made of an iron type metallic material.

The front end of the drive shaft 16 is supported on the front housing member 11 through a radial bearing 17. An accommodation hole 12*a* is formed substantially in the center of the cylinder block 12. The rear end of the drive shaft 16 is supported on the cylinder block 12 through a radial bearing 18, and the rear end of the drive shaft 16 located in the accommodation hole 12*a*.

An electromagnetic clutch 23 is provided between the engine Eg and the drive shaft 16. The clutch 23 selectively transmits the power of the engine Eg to the drive shaft 16. The electromagnetic clutch 23 includes a pulley 24, a hub 27, an armature 28 and an electromagnetic coil 29. The pulley 24 is rotatably supported on the front end of the front housing member 11 through an angular bearing 25. A belt 26 is wound over the pulley 24 to transmit the power of the engine Eg to the pulley 24. The hub 27 is elastic and is fixed to the front end portion of the drive shaft 16. The hub 27 supports the armature 28. The armature 28 opposes the pulley 24. The electromagnetic coil 29 is supported on the front wall of the front housing member 11 to oppose the armature 28 through the pulley 24.

When the coil 29 is energized when the engine Eg is running, a force based on the electromagnetic force pulls the armature 28 towards the pulley 24. Therefore, the armature 28 engages the pulley 24 against the elastic force of the hub 27, and the clutch 23 is engaged. In this state, the driving force of the engine Eg is transmitted to the drive shaft 16 through the belt 26 and the clutch 23 as shown in FIG. 1. When the electromagnetic coil 29 is demagnetized, the armature 28 is moved away from the pulley 24 by the elastic force of the hub 27, which disengages the clutch 23. When the clutch is disengaged, the transmission of the driving force from the engine Eg to the drive shaft 16 is shut off as shown in FIG. 2.

As shown in FIG. 1, a rotor 30 is fixed to the drive shaft 16 in the crank chamber 15. A thrust bearing 20 is located between the rotor 30 and the inner wall of the front housing member 11. A swash plate 31, which is also referred to as a drive plate, is supported on the drive shaft 16. The swash plate 31 moves in the axial direction L and inclines. A hinge mechanism 32 links the rotor 30 and the swash plate 31. The swash plate 31 is connected to the rotor 30 through the hinge mechanism 32. The hinge mechanism 32 drives the swash plate 31 together with the rotor 30. In addition, the hinge mechanism 32 guides the movement of the swash plate 31 on the drive shaft 16. When the swash plate 31 is moved toward the cylinder block 12, the inclination angle of the swash plate 31 decreases, and when the swash plate 31 is moved toward the rotor 30, the inclination angle of the swash plate 31 increases.

A restriction ring 34 is attached to the drive shaft 16 between the swash plate 31 and the cylinder block 12. As shown by the broken line in FIG. 1, when the swash plate 31 contacts the restriction ring 34, the inclination angle of the swash plate 31 is minimum. On the other hand, as shown by the solid line in FIG. 1, when the swash plate 31 contacts the rotor 30, the inclination angle of the swash plate 31 is maximum.

A plurality of cylinder bores (only one shown in FIG. 1) are located at equal intervals around the accommodation hole 12*a* and the axis L. A single head type piston 35 is fitted in each cylinder bore 33. Each piston 35 is connected to the swash plate 31 through a pair of shoes 36. The swash plate 31 converts rotation of the drive shaft 16 to reciprocation of the piston 35 in the cylinder bore 33.

A suction chamber 37, which is part of a suction pressure zone, is defined at substantially the center of the rear housing member 13. A discharge chamber 38, which is part of a discharge pressure zone, is formed around the suction chamber 37 in the rear housing member 13. The main plate 14*a* of the valve plate 14 includes a suction ports 39 and discharge ports 40 in correspondence with cylinder bores 33. The first subplate 14*b* includes suction valves 41 corresponding to the suction ports 39. The second subplate 14*c* includes discharge valves 42 corresponding to the discharge ports 40. The retainer plate 14*d* includes retainers 43 corresponding to the discharge valves 42. The retainer 43 defines the maximum degree of opening of the discharge valve 42 corresponding to the retainer 43.

The following description refers to one cylinder bore 33, however, this description applies to all the cylinder bores 33. When the piston 35 is moved from the top dead center position toward the bottom dead center position, refrigerant gas in the suction chamber 37 flows from the suction port 39 into the cylinder bore 33 while opening the suction valve 41. On the other hand, when the piston 35 is moved from the bottom dead center position toward the top dead center position, the refrigerant gas in the cylinder bore 33 is compressed to a predetermined pressure and is then discharged from the discharge port 40 to the discharge chamber 38 while opening the discharge valve 42. When the piston 35 is located at the top dead center position, a space containing compressed the refrigerant gas is defined between the head of the piston 35 and the front end surface of the valve plate 14, in the cylinder bore 33.

The compression load of the refrigerant gas that acts on each piston 35 is received by an inner wall face, or a first restriction surface 11*a*, through the shoes 36, the swash plate 31, the hinge mechanism 32, the rotor 30 and the thrust bearing 20.

A supply passage 44 connects the discharge chamber 38 with the crank chamber 15. A bleed passage 45 connects the crank chamber 15 with the suction chamber 37. A displacement control valve 46 is located in the supply passage 44. An electromagnetic displacement control valve 46 includes a valve body 46*a*, a solenoid 46*b* and an opening spring 46*c*. The valve body 46*a* opens and closes the supply passage 44. The solenoid 46*b* operates the valve body 46*a* in response to an external signal. The opening spring 46*c* urges the valve body 46*a* in the direction that increases the opening size of the supply passage 44.

When the level of the current supplied to the solenoid 46*b* is increased, the valve body 46*a* is moved in the direction that decreases the opening size the supply passage 44 against the force of the opening spring 46*c*. On the other hand, when the level of the current to the solenoid 46*b* is decreased, the valve body 46*a* is moved in the direction that increases the opening size the supply passage 44. In addition, when the current to the solenoid 46*b* is stopped, the valve body 46*a* fully opens the supply passage 44 due to the force of the opening spring 46*c*.

As described above, by controlling the opening size of the supply passage 44 by the displacement control valve 46, the amount of refrigerant gas supplied to the crank chamber is controlled, and the pressure in the crank chamber 15 is changed. Thus, the difference between the pressure of the crank chamber 15 and the pressure of the cylinder bore 33 through the piston 35 is changed, and the inclination angle of the swash plate 31 is changed. As a result, the stroke of each piston 35 is changed so that the discharge displacement is controlled.

When the pressure in the crank chamber 15 is increased and the difference between the pressure in the crank chamber and the pressure in the cylinder bore 33 is increased, for example, the inclination angle of the swash plate 31 is decreased, and the discharge displacement of the compressor is decreased. On the other hand, when the pressure in the crank chamber 15 is decreased and the difference between the pressure in the crank chamber 15 and the pressure in the cylinder bore 33 is decreased, the inclination angle of the swash plate 31 is increased and the discharge displacement of the compressor is increased.

When the electromagnetic clutch 23 is turned off, the current to the solenoid 46*b* is stopped. As a result, the displacement control valve 46 fully opens the supply passage 44. Thus, the pressure in the crank chamber 15 is increased and the swash plate 31 is moved to the minimum inclination angle. Consequently, the compressor is stopped in a state where the inclination angle of the swash plate 31 is minimum, in other words, in a state where the discharge displacement is minimum. Therefore, since the compressor is always started from a state of the minimum discharge displacement where the load torque is minimum, shock generated at the time of starting the compressor is reduced.

When driving power is required for accelerating the vehicle or for climbing a hill, the displacement control valve 46 fully opens the supply passage 44 so that the discharge displacement of the compressor is reduced to the minimum discharge displacement. As a result, the load on the engine Eg is reduced, and the vehicle can be rapidly accelerated.

When the vehicle is accelerated while the discharge displacement of the compressor is maximized, if the electromagnetic clutch 23 is turned off, the load on the engine Eg is reduced. However, since a shock is generated when the electromagnetic clutch 23 is engaged, which may disturb the driver.

Figures 2, 2A:
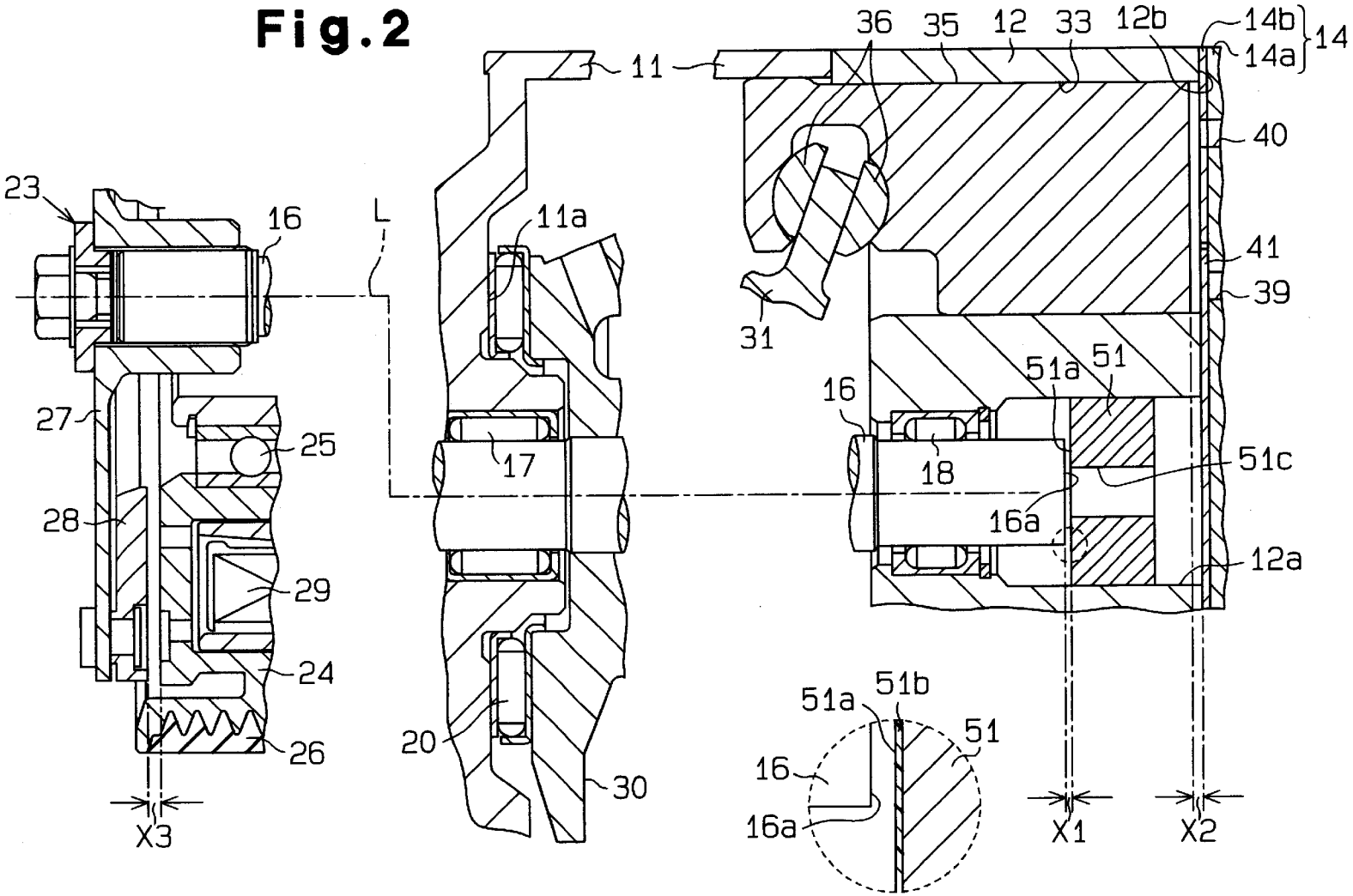
FIG. 2 is a partial, exploded, cross-sectional view of the compressor of FIG. 1.

As shown in FIG. 1 and FIG. 2, a restriction member 51 has a cylindrical shape and is coaxial with the axis L. The restriction member 51 is press fixed in the accommodation hole 12*a* of the cylinder block 12. A through hole 51*c* is formed at the center of the restriction member 51. The front end surface of the restriction member 51 functions as a second restriction surface 51*a* and faces the rear end surface 16*a* of the drive shaft 16. The rear end surface of the drive shaft 16 functions as a contact surface. The restriction member 51 is made of a material that has the same thermal expansion coefficient as that of the material (aluminum type metallic material) of the cylinder block 12 and is different from the material (iron type metallic material) of the drive shaft 16. The material of the restriction member 51 is, for example, an aluminum type material or brass type material having a thermal expansion coefficient near that of the aluminum type material. As shown in FIG. 2(*a*), a coat of fluoroplastics such as polytetrafluoroethylene or the like, and an abrasion resistant coating 51*b* of tin or the like are formed on the second restriction surface 51*a* of the restriction member 51.

As shown in FIG. 2, when forward movement of the drive shaft 16 is restricted by the first restriction surface 11*a* of the front housing member 11 via the thrust bearing 20, three clearances X1 to X3 are formed as follows. That is, the clearance X1 is formed between the contact surface 16*a* of the drive shaft 16 and the second restriction surface 51*a*. The clearance X2 is formed between the end surface of the piston 35, which is located at the top dead center position, and the first subplate 14*b* of the valve plate 14. The clearance X3 is formed between the pulley 24 and the armature 28 of the electromagnetic clutch 23 (which no current is supplied). The clearance X1 is smaller than the clearance X2 and the clearance X3. For example, the clearance X1 is about 0.1 mm, the clearance X2 is about 0.3 mm, and the clearance X3 is about 0.5 mm. In FIG. 2, the size of the respective clearances X1, X2, and X3 are exaggerated for illustrative purpose.

Next, an assembly method for the above-mentioned compressor, in particular, a procedure by the restriction member 51 is press-fitted into the accommodation hole 12*a* of the cylinder block 12 using a jig 61, will be described.

Figure 3A:
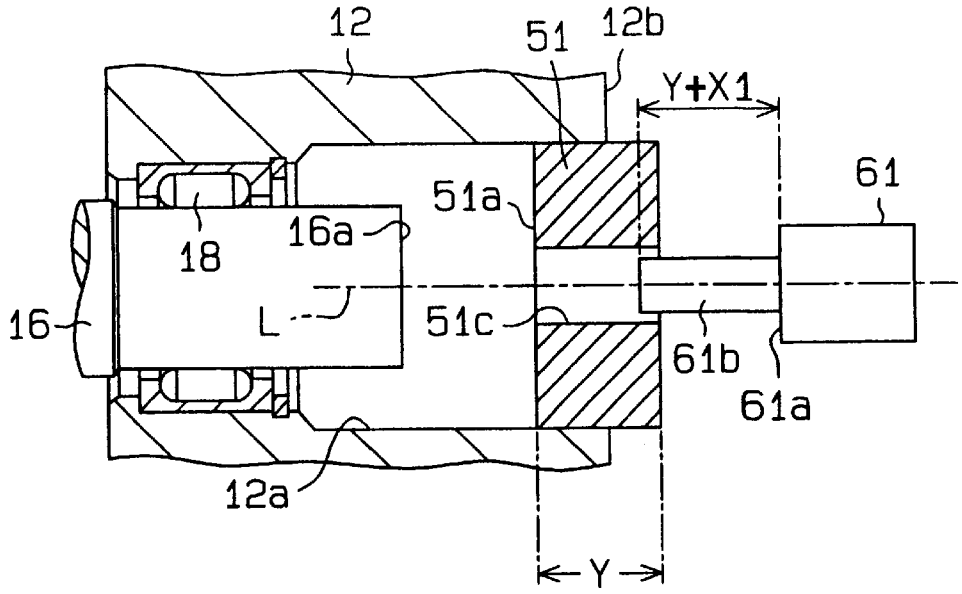
FIG. 3(*a*) is a partial enlarged cross-sectional view illustrating a state before a restriction member is accommodated in an accommodation hole.
Figure 3B:
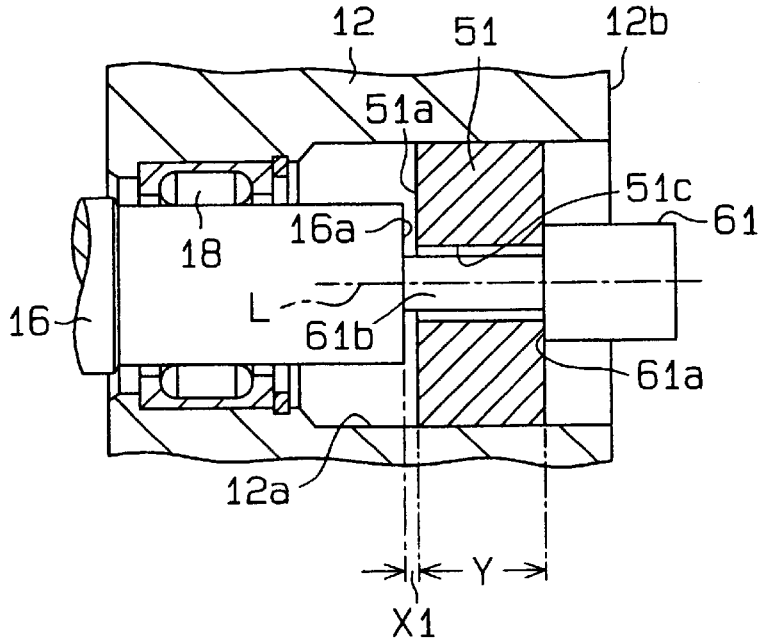

In FIG. 3(*a*) and FIG. 3(*b*), the principal portion of the compressor, before the electromagnetic clutch 23, the rear housing member 13 and the valve plate 14 are assembled, is shown in an enlarged scale. In this state the rear end of the accommodation hole 12*a* is open. The restriction member 51 is press-fitted into the accommodation hole 12*a* through this opening.

As shown in FIG. 3(*a*), the jig 61 is cylindrical and has a diameter smaller than that of the accommodation hole 12*a*. The jig 61 includes a large diameter portion 61*a* and a small diameter portion 61*b*, which extends from axially from the center of the large diameter portion 61*a*. The small diameter portion 61*b* extends from the large diameter portion 61*a* along the axis L by the distance Y along the axis L and the maximum clearance X1 formed between the contact surface 16*a* and the second restriction surface 51*a*. In other words, the allowable clearance X1 between the drive shaft 16 and the second restriction surface 51*a* is added to the distance Y to determine the length of the small diameter portion 61*b*.

As shown in FIG. 3(*b*), when the small diameter portion 61*b* is inserted into the through hole 51*c* of the restriction member 51, the large diameter portion 61*a* of the jig 61 contacts the rear end surface of the restriction member 51. Also, the small diameter portion 61*b* engages the contact surface 16*a* of the drive shaft 16 and pushes the drive shaft 16 forward. Thus, as shown in FIG. 2, the jig 61 presses and advances the restriction member 51 in the accommodation hole 12*a* to a position where the forward movement of the drive shaft 16 is restricted by the first restriction surface 11*a* via the thrust bearing 20. The axial distance by which the small diameter portion 61*b* extends from the second restriction surface 51*a* corresponds to a predetermined clearance X1 between the contact surface 16*a* and the second restriction surface 51*a*.

When electromagnetic clutch 23 is deactuated or the acceleration of a vehicle is executed when the discharge displacement of the compressor is maximum, for example, the displacement control valve 46 abruptly and fully opens the supply passage 44 from a fully closed state. Accordingly, the refrigerant gas in the discharge chamber 38 is supplied into the crank chamber 15 at a high rate. Since the bleed passage 45 cannot discharge the refrigerant gas at such a high rate, the pressure in the crank chamber 15 is abruptly increased, and the inclination angle of the swash plate 31 is rapidly reduced. As a result, the swash plate 31 (shown by the broken line in FIG. 1), when located at the minimum inclination angle, is pressed against the restriction ring 34 by excess force and the rotor 30 is strongly pulled in a rearward direction through the hinge mechanism 32. As a result, the drive shaft 16 is moved rearward.

However, in this embodiment, the clearance X1 is the smallest of the three clearances X1, X2, X3. Therefore, clearance (the maximum of which is X2) between one of the pistons 35 that is at the top dead center position and the valve plate 14 and clearance (the maximum of which is X3) between the pulley 24 of the electromagnetic clutch 23 and the armature 28 when the clutch 23 is deactuated exists even if the rearward movement of the driveshaft 16 is restricted by contact between the contact surface 16*a* and the second restriction surface 51*a* of the restriction member 51. Therefore, in operation, when one of the pistons 35 is moved to the top dead center position, collision with the valve plate 14 is avoided and vibrations, damage, and noise due to the collision to both elements 14 and 35 is prevented. In addition, when the electromagnetic clutch 23 is deactuated, noise and vibrations due to contact between the pulley 24 and the armature 28 and heat generation are prevented.

The present embodiment has the following effects.

Figure 7:
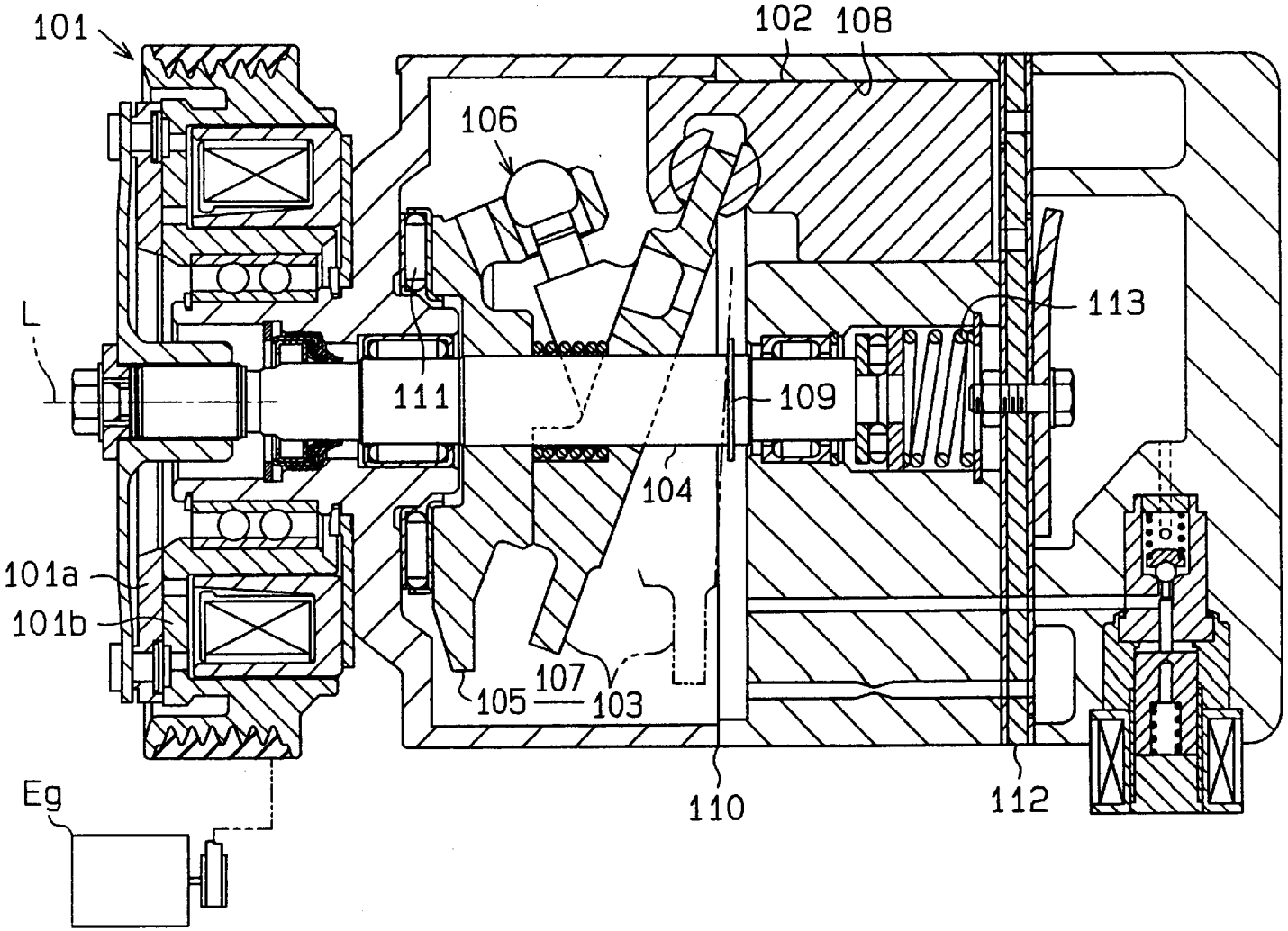
Fig.7 (Prior Art)
FIG. 7 is a cross-sectional view of a conventional compressor.

The compressor of the present embodiment does not have the support spring 113 in FIG. 7. Therefore, wear in the thrust bearing 111, which receives a load from the supporting spring 113, and the power loss of the compressor are reduced. The reduction in the power loss of the compressor reduces the fuel consumption of the vehicle engine Eg. Further, since the compressor does not have the supporting spring 113, there is no need for providing a thrust bearing between the drive shaft 16 and the supporting spring 113, which simplifies the structure.

By using the space that contains the rear end portion of the drive shaft 16, in other words, by using the space portion within the accommodation hole 12*a*, rearward movement of the drive shaft 16 is restricted.

The rear end surface of the drive shaft 16 is used as the contact surface 16*a*. Thus, the restriction structure that restricts the rearward movement of the drive shaft 16 is simple.

In a case where the restriction member 51 is integrated with the cylinder block 12, when the drive shaft 16 is assembled with the cylinder block 12, final grinding of the second restriction surface 51*a* is needed to obtain the respective desirable clearances X1, X2 and X3 (X1<X2, X3). Accordingly, the assembly is complicated. However, in the embodiment of the present invention, since the cylinder block 12 and the restriction member 51 are different parts, the position of the restriction member 51 within the accommodation hole 12*a* of the cylinder block 12 may be changed. Thus, the respective desirable clearances X1, X2 and X3 can be easily set.

The restriction member 51 is press-fitted in the accommodation hole 12*a* of the cylinder block 12. Therefore, the fixation of the restriction member 51 to the cylinder block 12 does not require a fastener such as a bolt or the like or an adhesive, and the assembly is performed by only pressing with the jig 61. In addition, the position of the second restriction surface 51*a* is easily determined in the accommodation hole 12*a*.

When the restriction member 51 is fixed by threads in the accommodation hole 12*a*, for example, the positioning of the second restriction surface 51*a* is carried out by controlling rotation of the restriction member 51. However, the restriction member 51 receives rotational force by contact with the drive shaft 16 (contact surface 16*a*) Thus, the position of the second restriction surface 51*a* in the accommodation hole 12*a* may be altered. However, in the embodiment, since the restriction member 51 is press-fitted in the accommodation hole 12*a*, the position of the second restriction surface 51*a* does not change.

The restriction member 51 is made of a material (an aluminum type or brass type metallic material) having the same thermal expansion coefficient as that of the material (aluminum type metallic material) of the cylinder block 12. Thus, the difference in the thermal expansion between the cylinder block 12 and the restriction member 51 is negligible, and the degree of interference between the restriction member 51 and the cylinder block 12 is not significantly changed. As a result, generation of a cracks the restriction member 51 or the cylinder block 12 due to changes in the interference and a changes of the clearance X1 by the movement of the second restriction surface 51*a* are prevented.

The restriction member 51 is made of material (aluminum type or brass type metallic material) that is different from the material (iron type metallic material) of the drive shaft 16 (contact surface 16*a*). Thus, as compared with a case where the restriction member 51 is made of the same metallic material as that of the drive shaft 16, seizing due to sliding between the contact surface 16*a* and the second restriction surface 51*a* does not occur.

As shown in FIG. 2(*a*), the abrasion resistant coating 51*b* is formed on the second restriction surface 51*a* of the restriction member 51. Therefore, deterioration of the second restriction surface 51*a* due to abrasion between the second restriction surface 51*a* and the contact surface 16*a* of the drive shaft 16 and a corresponding increase in the clearance X1 do not occur. As a result, collisions between the piston 35 and the valve plate 14 are prevented over an extended period, and contact between the pulley 24 and the armature 28 when the electromagnetic clutch 23 is deactivated is also prevented.

Compared to a pressure sensing valve that maintains the suction pressure at a target suction pressure, the displacement control valve 46 quickly changes the compressor displacement from the maximum level to the minimum level, that is, the valve 46 quickly increases the pressure in the crank chamber 15. The present invention is particularly effective in a compressor having a control valve like the control valve 46.

When press fitting the resrtiction member 51 into the accommodation hole 12*a*, the first restriction surface 11*a* prevents the drive shaft 16 from moving. As a result, the drive shaft 16 need not be prevented from moving by, for example, means other than the jig 61.

It is noted that in the second and third embodiments of the present invention, only the differences between the first embodiment and the embodiments are described, and the same members are denoted by the same reference numerals and the explanations thereof are omitted.

Figure 4:
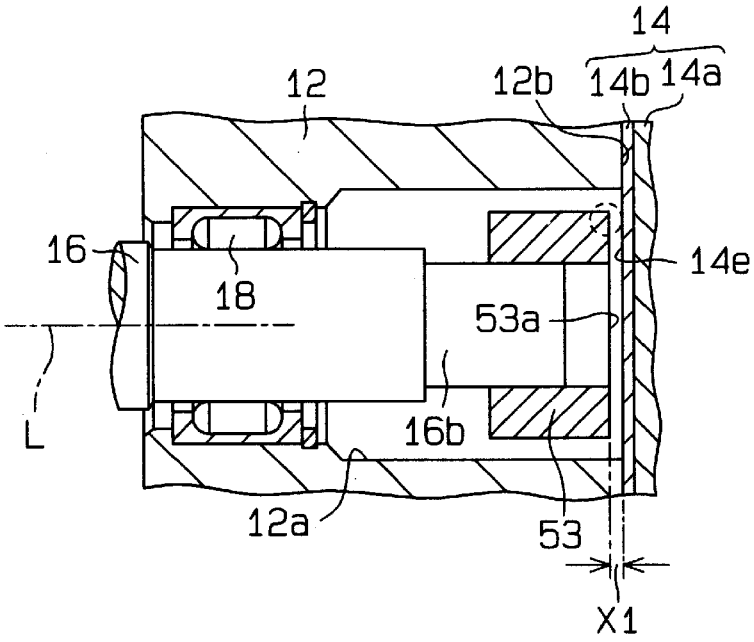
FIG. 4 is a partial enlarged cross-sectional view showing the drive shaft and a restriction member in a second embodiment of the present invention.
Figure 4A:
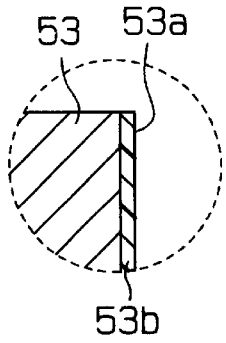

A second embodiment shown in FIG. 4(*a*) differs mainly from the first embodiment shown in FIGS. 1 to 3(*b*) in that there is a contact member 53, a contact surface 53*a* of which is made of a material different from that of the drive shaft 16 and that second restriction surface 14*e* is provides by the valve plate 14.

In this embodiment a cylindrical contact member 53 is press-fitted onto a small diameter portion 16*b* formed on the rear end of the drive shaft 16. The rear end surface of the contact member 53 functions as a contact surface 53*a*. A portion of the first subplate 14*b* of the valve plate 14, which faces to the contact surface 53*a* in the accommodation hole 12*a*, functions as the second restriction surface 14*e*. The contact member 53 is made of a material (for example, an iron type metallic material) having substantially the same thermal expansion coefficient as that of the material (an iron type metallic material) of the drive shaft 16. As shown in FIG. 4(*a*), a coat of fluoroplastics such as polytetrafluoroethylene or the like, and an abrasion resistant coating 53*b* of tin or the like are formed on the contact surface 53*a*.

Figure 5A:
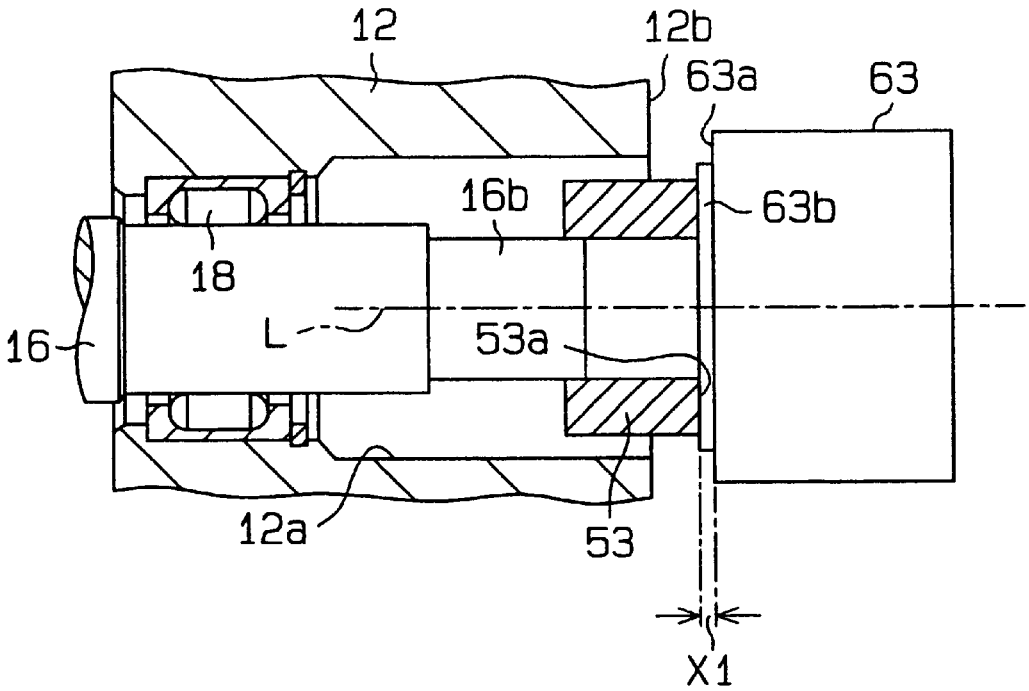
FIG. 5(*a*) is a partial enlarged cross-sectional view illustrating a state before the restriction member in FIG. 4 is accommodated in an accommodation hole.
Figure 5B:
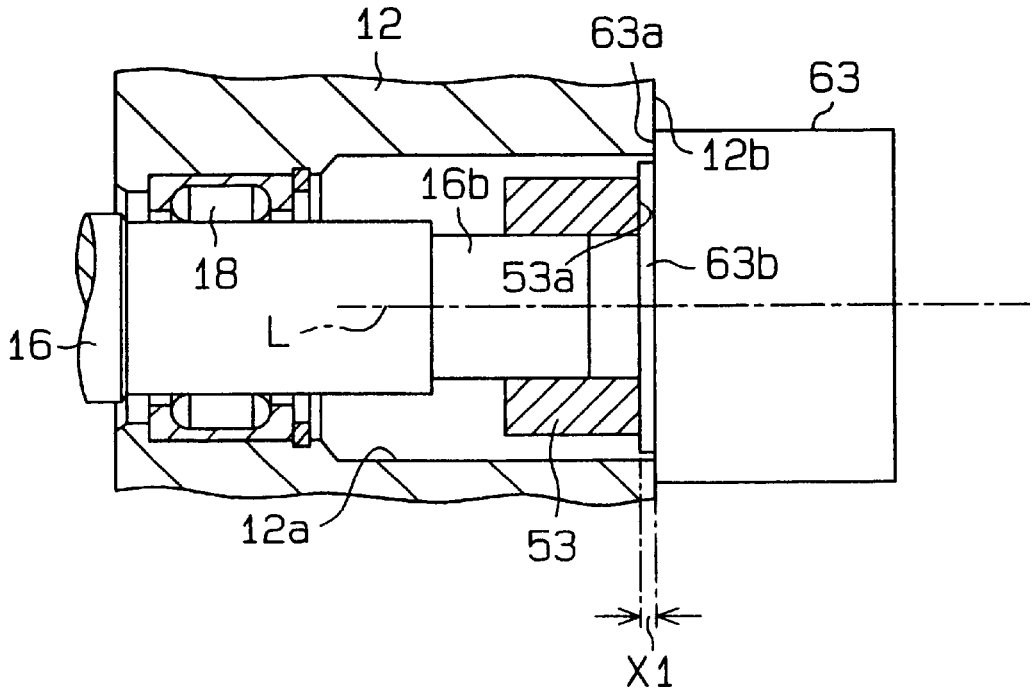

As shown in FIGS. 5(*a*) and 5(*b*), a jig 63 has an outer diameter larger than the accommodation hole 12*a*. The jig 63 has a cylindrical large diameter portion 63*a* and a small diameter portion 63*b*, which extends axially from the large diameter portion 63*a*. The small diameter portion 63*b* has a diameter smaller than that of the accommodation hole 12*a*. The small diameter portion 63*b* extends from the large diameter portion 63*a* by a distance equal to the maximum clearance X1 between the contact surface 53*a* and the second restriction surface 14*e*.

As shown in FIG. 5(*b*), when the contact member 53 is fitted onto the small diameter portion 16*b* of the drive shaft 16, the contact surface 53*a* is moved in the direction of the axis L by the small diameter portion 63*b* until the large diameter portion 63*a* contacts the rear end surface 12*b* of the cylinder block 12. Accordingly, the drive shaft 16 is press fitted into the contact member 53. When the forward movement of the drive shaft 16 is limited by the first restriction surface 11*a*, the press fitting motion is stopped. Therefore, a predetermined clearance X1 is defined between the contact surface 53*a* and the imaginary plane (the second restriction surface 14*e*) of the rear end surface 12*b* of the cylinder block 12. The clearance X1 corresponds to the axial dimension of the small diameter portion 63*b*.

The second embodiment has the following effects other than the same effects in the first embodiment shown in FIG. 1 to FIG. 3(*b*).

In the second embodiment, a valve plate 14 (a suction valve forming plate 14*b*) serves as the second restriction surface. Thus, the structure that restricts the movement of the drive shaft 16 is simple.

For example, if the contact member 53 were directly formed on the drive shaft 16, after the drive shaft 16 is actually assembled with the cylinder block 12, finish grinding of the contact surface 53*a* of the drive shaft 16 is needed to obtain the respective required clearances X1, X2 and X3 (X1<X2, X3). However, in this embodiment, the contact surface 53*a* is formed by the contact member 53 which is a different part from the drive shaft 16. Thus, it is easy to form the respective desired clearances X1, X2 and X3.

The contact member 53 is press fitted on the small diameter portion 16*b* of the drive shaft 16. Thus, mounting hardware such as bolts or adhesive are not required for fixing the contact member 53 to the drive shaft 16, which simplifies the assembly. In addition, the position of the contact surface 53*a* is easily determined by press fitting the contact surface 53*a* on the drive shaft 16.

When the contact member 53 is fixed to the drive shaft 16 by threading, for example, the positioning of the contact surface 53*a* is determined by-rotation of the contact member 53. However, the contact member 53 which is rotated together with the drive shaft 16 receives rotational force when it contacts the second restriction surface 14*e*, and the position of the contact surface 53*a* with respect to the drive shaft 16 may change. In the second embodiment, however, since the contact member 53 is press-fitted to the drive shaft 16, the positioning of the contact surface 53*a* does not change.

The contact member 53 is made of a material (an iron type metallic material) having the same thermal expansion coefficient as that of the material (iron type metallic material) of the drive shaft 16. Thus, since the difference in thermal expansion between the drive shaft 16 and the contact member 53 is negligible, the clearance X1 does not change as in the first embodiment.

As shown in FIG. 4(*a*), an abrasion resistant coating 53*b* is formed on the contact surface 53*a* of the contact member 53. Therefore, deterioration of the contact surface 53*a* due to abrasion between the second restriction surface 14*e* and the contact surface 53*a* and a corresponding increase in the clearance X1 are prevented. As a result, collisions between the piston 35 and the valve plate 14 are prevented over an extended period, and contact between the pulley 24 and the armature 28 is also prevented.

The jig 63 has a large diameter portion 63*a* for restricting the movement of the small diameter portion 63*b* into the accommodation hole 12*a*. Thus, in the process of press-fitting the contact member 53 in the drive shaft 16 while the movement of the drive shaft 16 is restricted by the first restriction surface 11*a*, the desired clearance X1 is set.

The present invention may be modified as follows.

Figure 6:
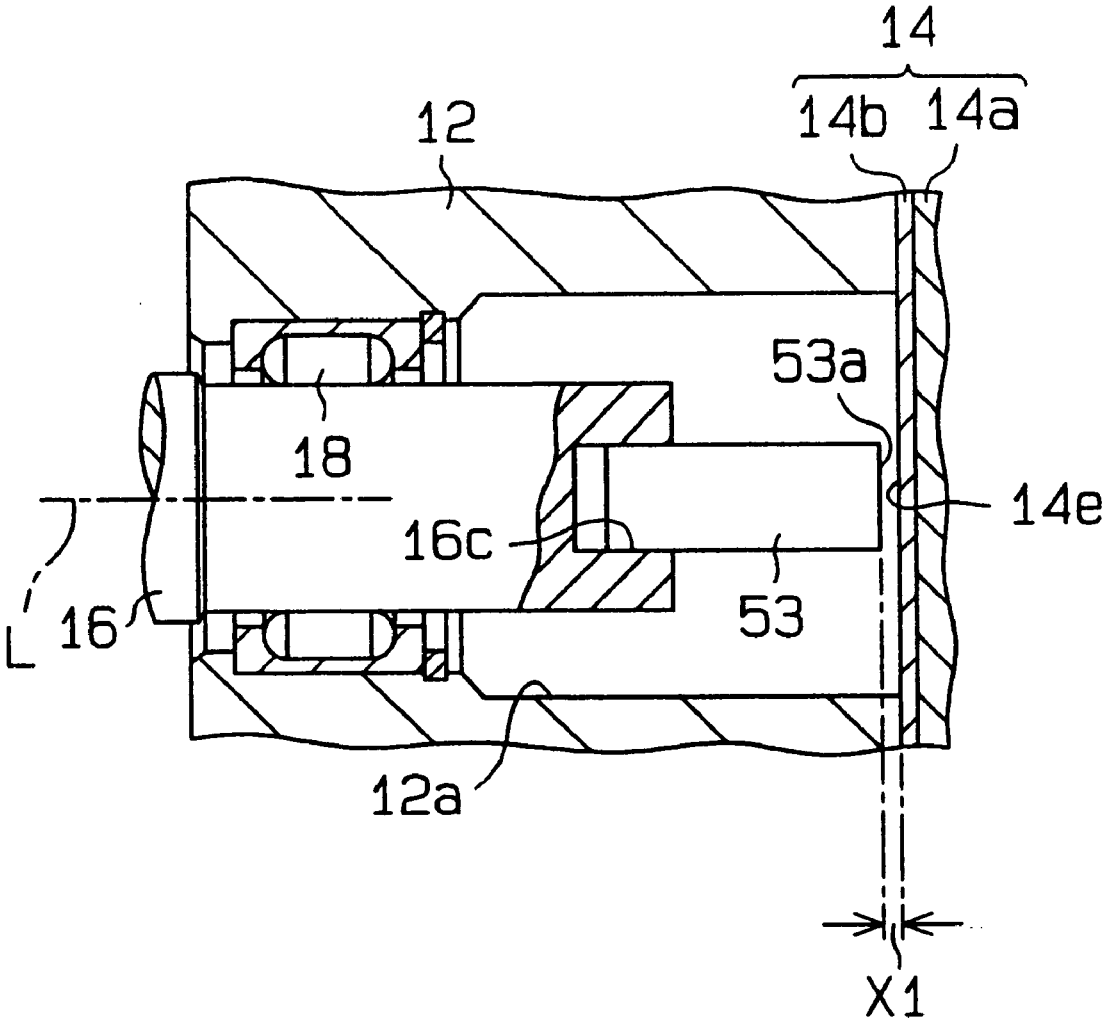
FIG. 6 is a partial enlarged cross-sectional view showing the drive shaft and a restriction member in a third embodiment of the present invention.

As shown in a third embodiment of FIG. 6, the contact member 53 may be fitted in a hole 16*c* formed in the drive shaft 16.

The restriction ring 34 may function as a contact portion, and the inner wall surface of the cylinder block 12 may function as the second restriction surface. That is, a structure that limits the rearward movement of the drive shaft 16 may be formed at a location other than the end of the drive shaft 16.

In the embodiment shown in FIG. 1 to FIG. 3(*b*), an abrasion resistant film may also be formed on the contact surface 16*a* of the drive shaft 16. In addition, in the embodiment shown in FIG. 4 to FIG. 5(*b*), an abrasion resistant coating may also be formed on the second restriction surface 14*e* of the valve plate 14.

As an abrasion resistance imparting process for forming a coating other than the abrasion resistant coating 51*b* and 53*b* of the above-mentioned embodiments, a soft nitriding process, or a metal spray coating such as copper spray coating may be executed.

In addition, the compressor in which the present invention is embodied may be a clutchless type compressor. In this case, during operation of the engine Eg, the drive shaft 16 is always rotated.

The present invention can be embodied in a wobble type variable displacement compressor or a fixed displacement compressor in which a swash plate 31 is directly secured to the drive shaft 16.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive and the invention is not to be limited to the details given herein, but may be modified within the scope and equivalence of the appended claims.

What is claimed is:

1. A piston type compressor comprising:

a housing;

a crank chamber formed in the housing;

a drive shaft rotatably supported by the housing in the crank chamber, wherein the drive shaft has an end surface;

a cylinder bore formed in the housing;

a piston located in the cylinder bore, wherein the piston reciprocates between a top dead position and a bottom dead position;

a valve plate located at an opposite side of the piston from the crank chamber;

a swash plate connected with the piston to change the rotation of the drive shaft to reciprocation of the piston, wherein the swash plate integrally rotates with the drive shaft;

a front restriction and a rear restriction located in the housing and for restricting a movement in the axial direction of the drive shaft, wherein the front restriction restricts the axial movement of the drive shaft in a forward direction, wherein the rear restriction restricts axial movement of the drive shaft in a rear direction; and a first clearance formed between the end surface of the drive shaft and the rear restriction when the movement of the drive shaft is restricted by the front restriction, wherein a second clearance is formed between the piston and the valve plate when the movement of the drive shaft is restricted by the front restriction and when the piston is in the top dead center position, wherein the first clearance is smaller than the second clearance.

2. The piston type compressor according to claim 1, wherein the drive shaft has an end portion, which includes the end surface, wherein an accommodation hole is formed in the housing, wherein the accommodation hole accommodates the end portion, wherein the rear restriction is located in the accommodation hole.

3. The piston type compressor according to claim 1 further comprising a restriction member, wherein a surface of the restriction member functions as the rear restriction.

4. The piston type compressor according to claim 3, wherein the restriction member is press fitted in the accommodation hole.

5. The piston type compressor according to claim 4, wherein the heat expansion coefficient of the material of the restriction member is substantially equal to the heat expansion coefficient of the material of the housing.

6. The piston type compressor according to claim 1, wherein a contact member is attached to the end of the drive shaft, wherein a surface of the contact member is the end surface of the drive shaft.

7. The piston type compressor according to claim 6, wherein the contact member is press fitted to the drive shaft.

8. The piston type compressor according to claim 7, wherein the heat expansion coefficient of the material of the contact member is substantially equal to the heat expansion coefficient of the material of the drive shaft.

9. The piston type compressor according to claim 6, wherein a surface of the valve plate functions as the rear restriction, and wherein the axial movement of the drive shaft in the rear direction is restricted when the contact member contacts the surface of the valve plate.

10. The piston type compressor according to claim 1, wherein the rear restriction has a through hole, which faces the end surface of the drive shaft.

* * * * *

UNITED STATES PATENT AND TRADEMARK OFFICE

CERTIFICATE OF CORRECTION

PATENT NO. : 6,547,533 B2
DATED : April 15, 2003
INVENTOR(S) : Ota et al.

It is certified that error appears in the above-identified patent and that said Letters Patent is hereby corrected as shown below:

Column 6,
Line 58, please delete “chamber is” and insert therefore -- chamber 15 is --;

Column 6, line 67-Column 7, line 1,
Please delete “chamber and” and insert therefore -- chamber 15 and --;

Column 10,
Line 50, please delete “provides” and insert therefore -- provided --;

Column 11,
Line 49, please delete “by-rotation” and insert therefore -- by rotation --.

Signed and Sealed this

Sixteenth Day of September, 2003

JAMES E. ROGAN
*Director of the United States Patent and Trademark Office*